US005148973A

United States Patent [19]

Zimmermann

[11] Patent Number: 5,148,973

[45] Date of Patent: Sep. 22, 1992

[54] INTERLOCKING CARTON AND LID

[75] Inventor: John Zimmermann, Scarborough, Canada

[73] Assignee: Paperboard Industries Corporation, Toronto, Canada

[21] Appl. No.: 818,383

[22] Filed: Jan. 9, 1992

[51] Int. Cl.[5] ..... B65D 43/08

[52] U.S. Cl. ..... 229/125.28; 229/125.26

[58] Field of Search ..... 229/125.19, 125.26, 229/125.28, 125.01

[56] References Cited

U.S. PATENT DOCUMENTS

| | | | |
|---|---|---|---|
| 2,456,841 | 12/1948 | Rushing | 229/125.28 |
| 2,551,814 | 5/1951 | Rushing et al. | 229/125.28 |
| 2,777,630 | 1/1957 | Moberger | 229/125.28 |
| 3,337,116 | 8/1967 | Nowak | 229/125.28 |
| 3,352,475 | 11/1967 | Centanni | 229/125.28 |
| 4,915,291 | 4/1990 | Galber | 229/125.26 |
| 5,040,722 | 8/1991 | Fromion et al. | 229/125.26 |

FOREIGN PATENT DOCUMENTS

| | | | |
|---|---|---|---|
| 2644139 | 9/1990 | France | 229/125.26 |

*Primary Examiner*—Stephen Marcus
*Assistant Examiner*—Christopher J. McDonald
*Attorney, Agent, or Firm*—Fetherstonhaugh & Co.

[57] ABSTRACT

An interlocking carton and lid combination is disclosed for storage of ice cream, frozen yogurt and the like. The interlocking combination includes a rectangular container provided with flaps integrally formed therewith and attached along the upper edges of the container sides. The flaps are folded along a crease inwardly into the container and glued along a strip portion to the side walls. A slit is provided in each of two opposed sides on the exterior thereof, the slits being formed in the side walls at a position adjacent the flaps and located below the crease and above the glue strip adhesively coupling the flap to the side wall. This positioning of the slit with respect to the crease and glue strip cause the unglued portion of the flap to bow outwardly. A lid having a central portion is provided with transversely extending flanges attached along the peripheral edges of the central portion and integrally formed therewith. The flanges include an outer side and an inner flap portion connected along a crease. Two opposed flanges have slits located in the respective flap portions and the flaps are glued to the respective outer sides along a strip portion located between the slit and the edge of the flange spaced from the crease. This configuration causes the unglued portion of the flap between the crease and the slit to bow outwardly. The lid is receivable on the container wherein the lid slits interfere with the container side slits.

5 Claims, 4 Drawing Sheets

INTERLOCKING CARTON AND LID

FIELD OF THE INVENTION

The subject invention relates to self locking carton and lid combinations.

BACKGROUND OF THE INVENTION

The need for interlocking cartons and lids for foodstuffs such as ice cream and yogurt to mention just a few is well known. Current interlocking carton and lid designs are of several types. In one such design of an ice cream container each side of the carton is provided at the upper end with an integrally formed peripheral flap which is folded down and glued on the outside of the carton. The bottom edge of this flap forms a catching edge. A drawback to this type of arrangement is the added fabrication expense associated with an extra pass in the carton gluing procedure.

In another locking arrangement, a cardboard container and a plastic lid is provided in which the plastic lid includes a deep peripheral grove portion which receives the upper peripheral edge of the container. Notches extending into the grove from the plastic lid must friction fit into die-cut apertures in several places on flanges located on the interior of the cardboard container. Several drawbacks to this type of arrangement are the need for critical manufacturing tolerances which increase fabrication costs. Also, during production, the lid must be carefully aligned with the container when fitting the former to the latter. Finally, the apertures located on the interior of the container become clogged with the material being stored therein which interferes with the locking function.

Accordingly, it would be desirable to provide an ice cream carton and lid assembly utilizing a locking mechanism which minimizes fabrication and assembly costs and which mechanism is not interfered with by the material being stored in the container.

SUMMARY OF THE INVENTION

The subject invention provides an interlocking carton and lid assembly for storing of ice cream and the like. In one aspect of the invention a generally rectangular storage carton is provided having side members and a bottom member, the carton including a top opening for providing access into the interior of the carton. At least two opposed side members are provided each with a peripheral flap integrally formed therewith at the upper edges thereof adjacent the top opening with the flaps adhesively coupled to the interior surface of the corresponding side members. The connection between the flaps and the side members forms a crease, with the at least two opposed side members each provided with at least one slit located therein at a predetermined position between the crease and the outer edge of the flap. The adhesive coupling between the flap and the interior surface of the side member is positioned between the slit and the outer edge of the flap. This configuration causes the unglued portion of the side member located between the crease and the slit to bow outwardly due to spring tension created in the unglued portion by the close proximity of the slit to the crease.

There is also provided a lid having a generally rectangular central portion wherein each peripheral edge portion of the lid is provided with a flange member integrally formed therewith and extending substantially perpendicularly therefrom. At least two opposed flange members are provided each with a flap member attached to the outer peripheral edge thereof and which is integrally formed therewith. The connection between the flaps and the flange member forms a crease. The flaps are adhesively coupled to the interior surface of the corresponding flange members with the at least two opposed flange members each provided with at least one slit located therein at a predetermined position between the crease and the outer peripheral edge of the flap. The adhesive coupling between the flap and the interior surface of the flange member is positioned between the slit and the outer edge of the flap, wherein that unglued portion of the flap member located between the crease and the slit is bowed outwardly due to spring tension created in the unglued portion by the close proximity of the slit to the crease.

The lid member is receivable onto the carton in such a way that the slits in the flaps of the lid member pass over and are in registration with the slits located in the side members. The bowed out portion of the flap in the container lid passes over the bowed out portion of the container side so that the respective slits interfere with one another thereby locking the lid and carton together.

BRIEF DESCRIPTION OF THE DRAWINGS

The invention will now be described by way of example only, with reference to accompanying drawings, in which.

DETAILED DESCRIPTION OF THE INVENTION

Figure 1:
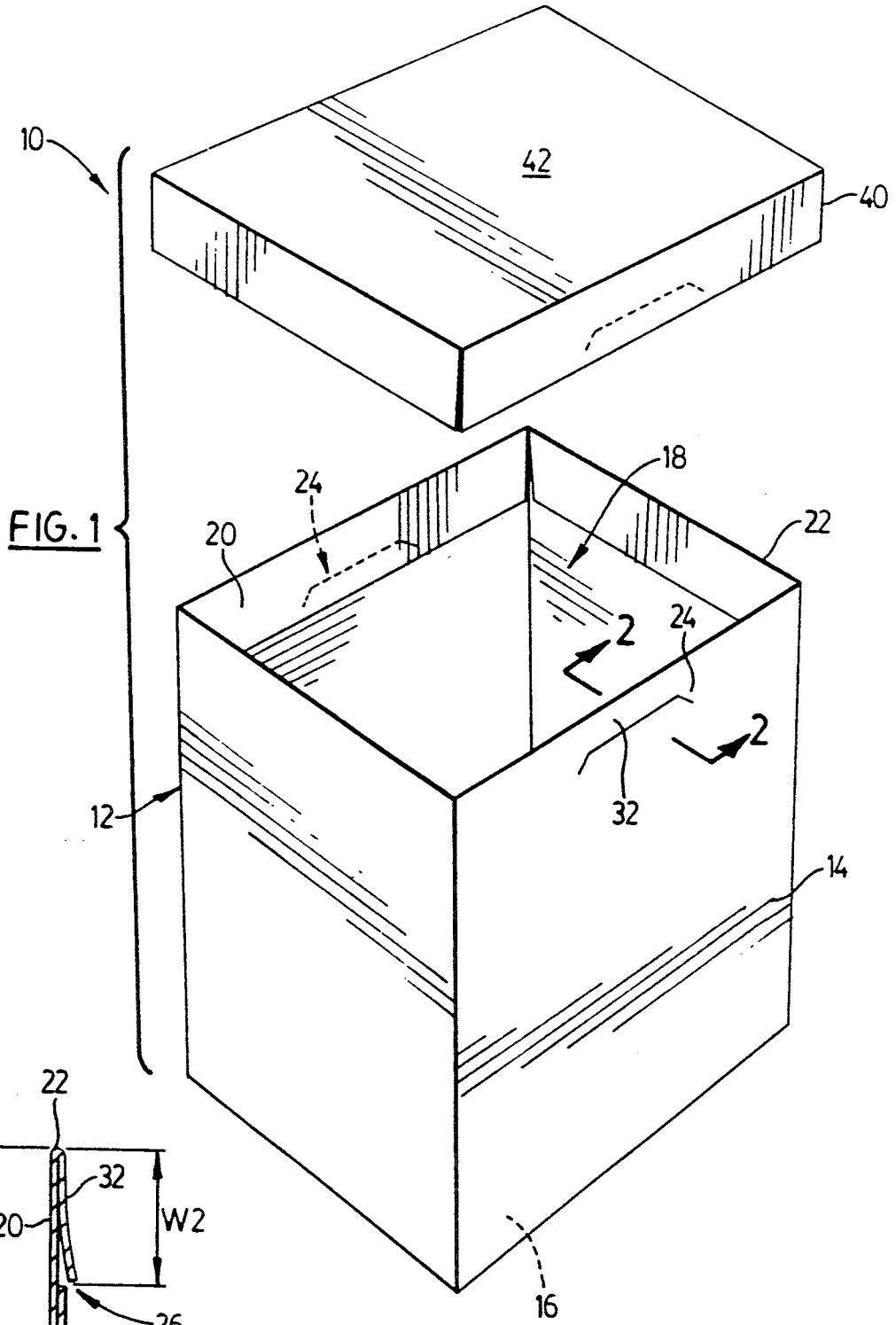
FIG. 1 is a perspective view of a carton and lid provided with a locking mechanism in accordance with the subject invention.
Figure 2:
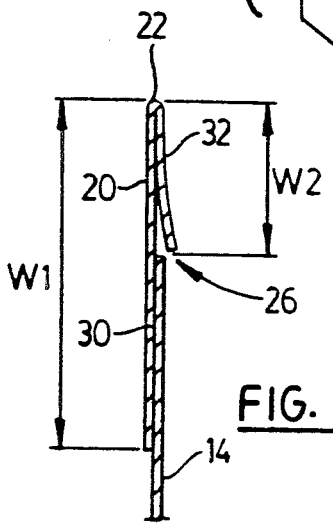
FIG. 2 is a sectional side view of the upper portion of the carton taken along the lines 2—2 of FIG. 1.
Figure 3:
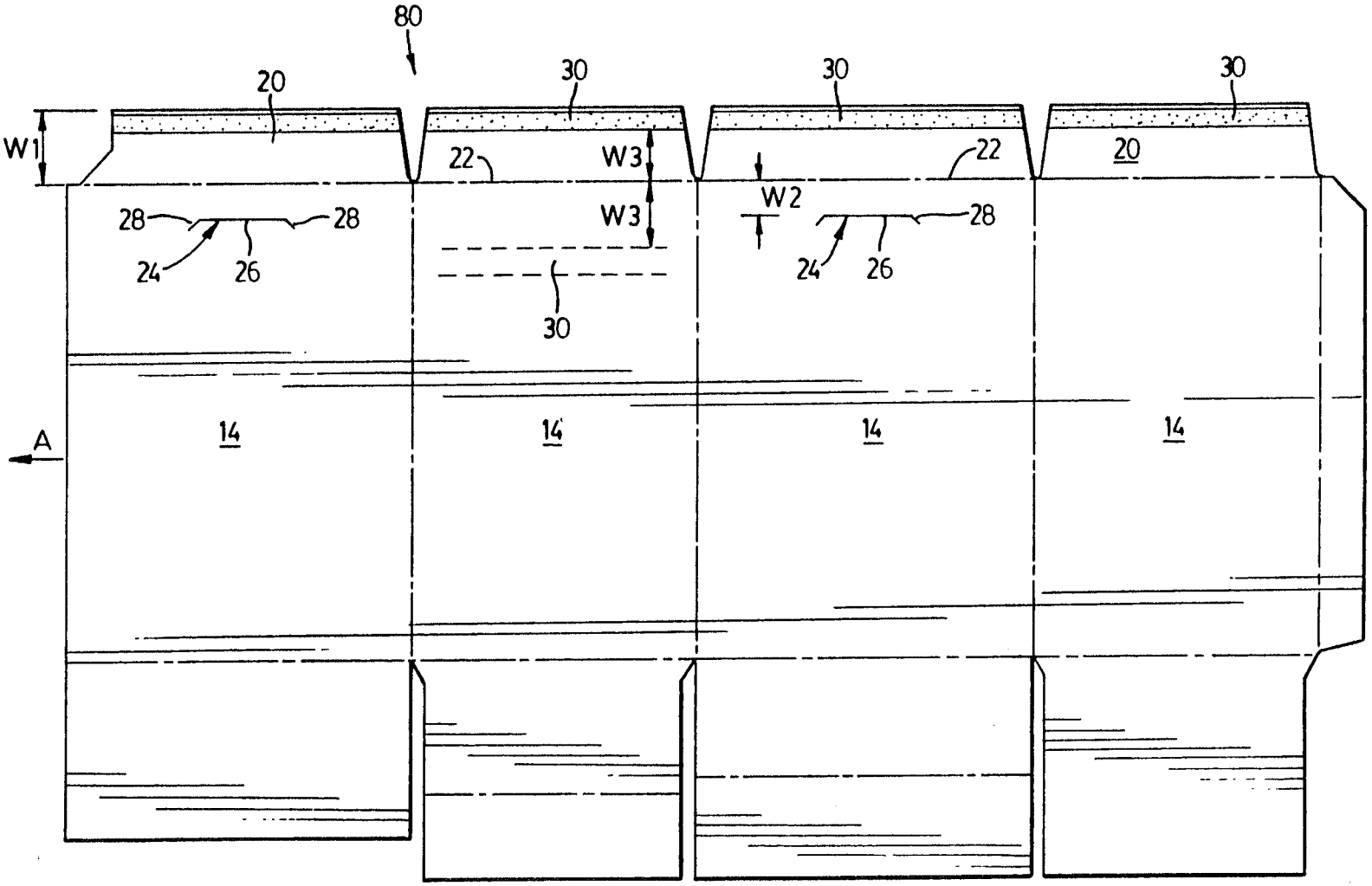
FIG. 3 is a top view of a carton blank provided with the locking mechanism of the subject invention.

In the ensuing description of the structure and operation of the locking mechanism of the subject invention, reference will be made to the Figures wherein like numerals refer to like parts. Referring first to FIGS. 1 to 3, a rectangular shaped carton and lid assembly 10 are shown and include a carton 12 having sides 14 and a bottom 16. Carton 12 has a top opening 18 for adding to and removing material from container 12. Sides 14 are each provided with a flap 20 of width W1 integrally formed therewith and connected along the upper edge thereof. Flaps 20 are folded inwardly into the interior of carton 12 thereby forming creases 22 along the upper edges of sides 14.

Carton 12 is provided with a pair of slits 24 with each slit located on an opposed side 14. Slits 24 are provided with a horizontal portion 26 and end portions 28 extending at an angle downwards. Slit portion 26 is spaced a distance W2 from crease 22 wherein $W2 < W1$. Flaps 20 are adhesively bonded to the inner surface of sides 14 along an adhesive strip or glue seam 30 wherein the glue seam is positioned so that when flap 20 is bonded to wall 14, slit 24 is located between the glue seam and crease 22. The unfolded carton shown in FIG. 3 more clearly illustrates the relative positioning of glue seam 30 on flaps 20, the latter being spaced W3 (>W2) from crease 22 and the positioning of slits 24 in sides 14. Referring to FIG. 2, the portion 32 of side 14 located between horizontal slit portion 26 and crease 22, is bowed outwardly, this outward bowing being due to tension generated in portion 32 in a direction normal to the plane of side 14 due in part to the close proximity of crease 22 and the fibrous nature of the cardboard material from which carton 12 is fabricated.

Figure 4:
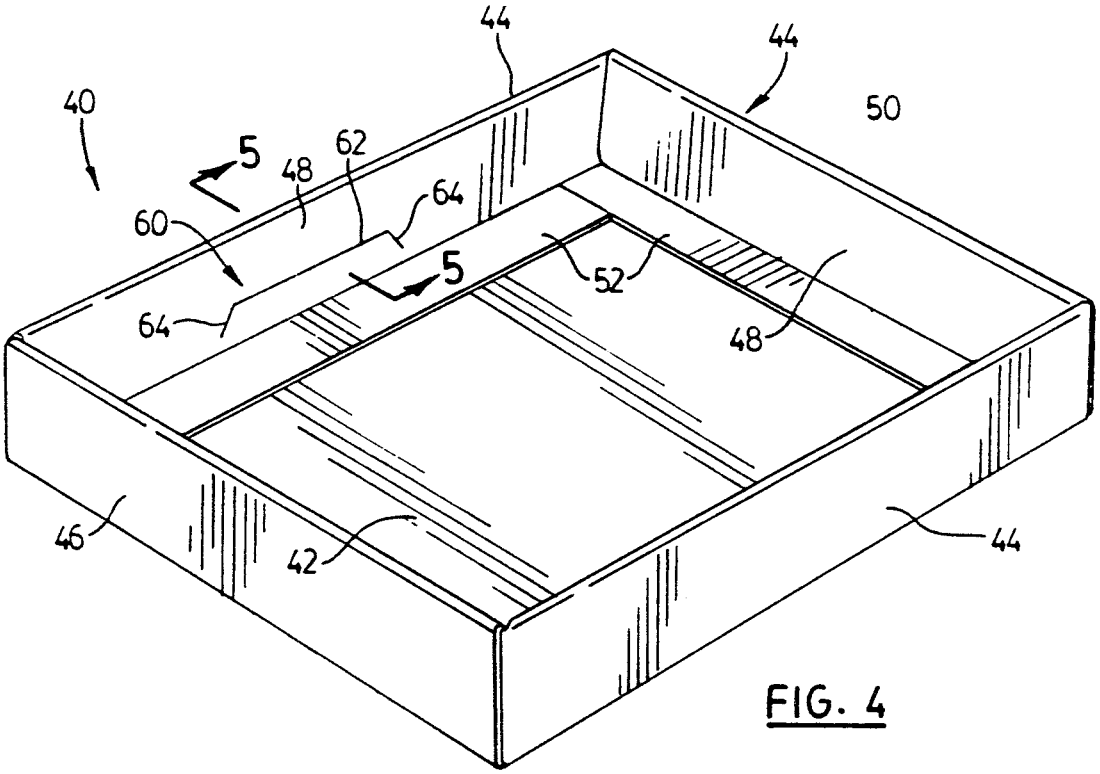
FIG. 4 is a perspective view of the interior of the lid of FIG. 1.
Figure 5:
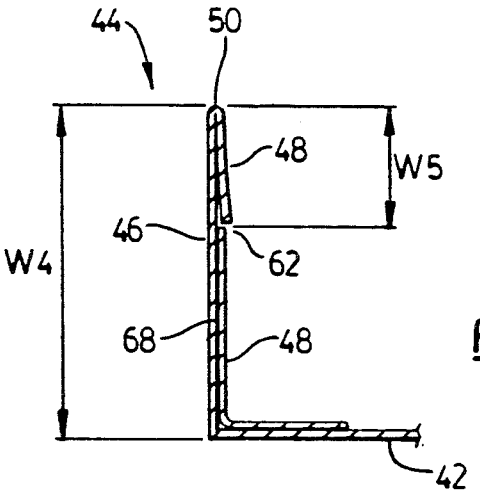
FIG. 5 is a sectional side view of the lid taken along the lines 5—5 of FIG. 4.
Figure 6:
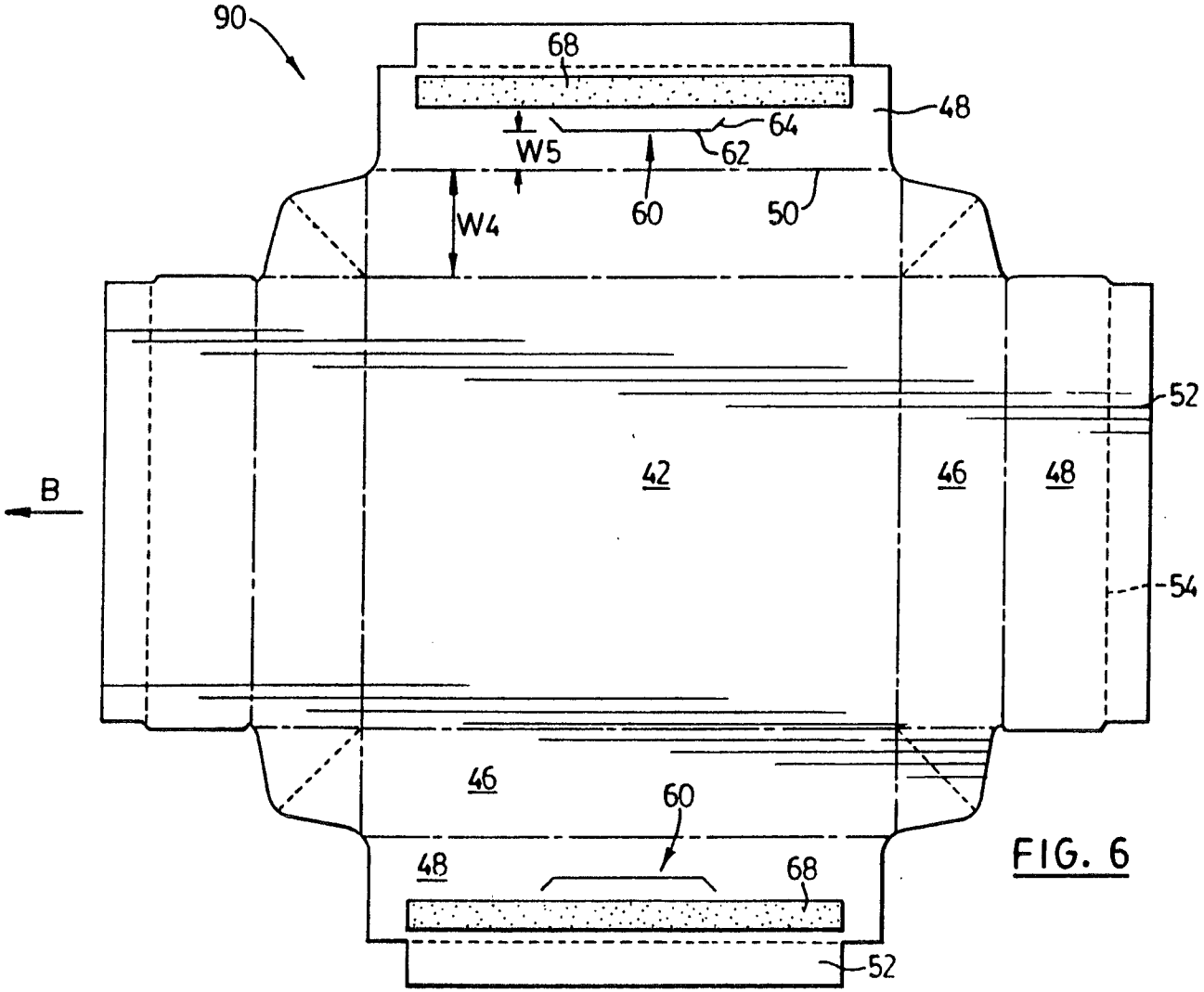
FIG. 6 is top view of a carton lid blank embodying the locking mechanism of the subject invention.

Referring now to FIGS. 4, 5 and 6, a lid shown generally at 40 is provided for carton 12. Lid 40 includes a top portion 42 and side flanges 44 connected to the outer peripheral side edges of top portion 42. Side flanges 44 are of width W4 and are preferably integrally formed with top portion 42 and extend transversely therefrom. Flanges 44 include an outer portion 46 and an inner flap member 48 attached to portion 46 along the peripheral edge of portion 46 and integrally formed therewith. Flaps 48 are folded inwardly into the interior of lid 40 thereby forming creases 50 along the bottom edges of flanges 44. Attached along the peripheral edge of flap portions 48 are reinforcing elongate tabs 52 integrally formed therewith which are folded along crease 54 and lie against top portion 42.

Lid 40 is provided with a pair of slits 60 one located on each of a pair of opposed flap 48. Slits 60 are provided with a horizontal portion 62 and end portions 64 extending at an angle outwardly and downwardly. Slit portion 62 is spaced a distance W5 from crease 50 wherein W4>W5. Flaps 48 are adhesively bonded to the inner surface of flange outer portion 46 along an adhesive strip or glue seam shown generally at 68 wherein strip portion 68 is positioned so that when flap 48 is bonded to flange portion 68, slit 62 is located between adhesive strip 68 and crease 50. The blank lid 90 shown in FIG. 6 more clearly illustrates the relative positioning of adhesive strips 68 and slits 60 on flaps 48. The portion of flap 48 located between slit 60 and crease 50, shown at 70, is bowed outwardly as shown in FIG. 5, this outward bowing being due to tension generated in portion 70 in a direction out of the plane of side flap 48 due in part to the close proximity of crease 50 and the fibrous nature of the cardboard material from which lid 40 is fabricated.

Referring to the top views of FIGS. 3 and 6, end slit portions 28 and 64 extend outwardly from the respective central slit portions at an angle less than 90 degrees in order to avoid problems during fabrication of the carton and lid portions. Specifically, the lid and carton blanks 90 and 80 respectively move in the direction indicated by arrows A and B in FIGS. 3 and 6. It has been found that if the slit end portions are angled at 90 degrees relative to the central slit portions and hence the direction of travel, these end slit portions are inadvertently grabbed by various pieces of equipment thereby necessitating the shutdown and realignment. By angling the slit end portions as disclosed herein, this problem is reduced while still facilitating the bowing outwards of the unglued flap and side portions.

To provide for the interlocking combination of lid 40 and carton 12, the dimensions W2, W4 and W5 are chosen to satisfy the inequality W4−W5>W2, while simultaneously satisfying the criteria that W2 and W5 be sufficiently small so that the respective unglued portions 32 and 48 adjacent slits 24 and 60 respectively are bowed outwardly.

Figure 7:
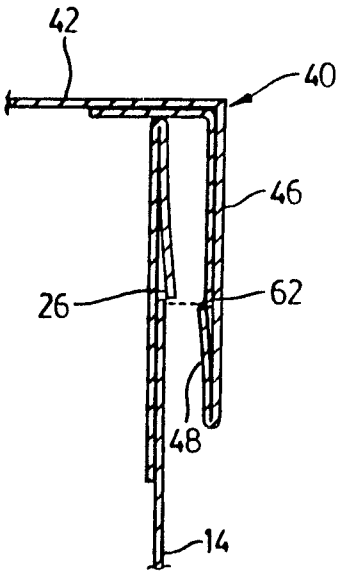
FIG. 7 is a sectional view showing the relationship of a portion of the lid and carton in the closed position with the carton side wall and lid shown spaced apart.

In operation, lid 40 is oriented to be received by carton 12 so that the flanges of lid 40 containing the slits 60 are in registration the sides 14 of carton 12 containing the slits 24. Since W4−W5 is slightly greater than W2, the lid bowed out portions 48 pass over the carton side wall bowed out portions 32 as lid 40 is pressed all the way onto carton 12 so that slit portions 62 and 26 come into registration as shown in FIG. 7 except that the slits are spaced apart along the dotted line for clarity. In the closed position, the edge of portion 70 adjacent slit 62 of the lid abuts the edge of portion 32 of adjacent slit 24 thereby locking the lid and carton together. Peripheral tabs 52 abutting creases 22 aid in forming an air tight seal between the lid and carton thereby forming a positive lock.

In order to remove lid 40 from carton 12, the sides 14 containing slits 24 are squeezed inwardly a sufficient distance to compress portions 32 inwardly with respect to inwardly protruding portions 70 of lid 40, whereupon lid 40 can be readily removed from carton 12.

The locking mechanism disclosed herein has been discussed using one slit located on opposed container sides and opposed flanges of the lid. It will be appreciated that more than one slit may be utilized on the opposed container sides and lid flanges so long as each slit in the former is in registration with a slit in the latter. In addition, while the slit portions shown adjacent the bowed out portions are parallel the respective creases, it will be understood that these slit portions could be inclined at an angle with respect to the creases without departing from the width parameters.

Therefore, while the present invention has been described and illustrated with respect to the preferred and alternative embodiments, it will be appreciated that numerous variations of these embodiments may be made without departing from the scope of the invention, which is defined in the appended claims.

The embodiments of the invention in which an exclusive right or privilege is claimed are defined as follows:

1. An interlocking carton and lid, comprising:

a) a generally rectangular storage carton having side members and a bottom member, the carton provided with a top opening for providing access into the interior of said carton, at least two opposed side members provided each with a peripheral flap integrally formed therewith at the upper edges thereof adjacent said top opening, the flaps adhesively coupled to the interior surface of the corresponding side members, the connection between the flaps and the side members forming a crease, said at least two opposed side members each provided with at least one slit located therein at a predetermined position between said crease and the outer edge of said flap, the adhesive coupling between said flap and the interior surface of the side member being positioned between said slit and the outer edge of said flap, wherein that unglued portion of the side member located between the crease and the slit is bowed outwardly due to spring tension created in said unglued portion by the close proximity of said slit to said crease; and b) a lid member having a generally rectangular, central portion, the peripheral edge portion of each side member provided with a flange member integrally formed therewith and extending substantially perpendicularly therefrom, the flange members including an outer member and an inner flap member, the connection between the inner flap portions and the outer members forming a crease, the flaps adhesively coupled to the interior surface of the corresponding outer members, said at least two opposed flange members each provided with at least one slit located on the flap member at a predetermined position between said crease and the outer peripheral edge of said flap, the adhesive coupling between said flap and the interior surface of the flange outer member being positioned between said slit and the outer edge of said flap, wherein that unglued portion of the flap member located between the crease and the slit is bowed outwardly due to spring tension created in said unglued portion by the close proximity of said slit to said crease, the slits in the lid and carton being so located such that when the lid is placed on the carton the bowed out portion in the flap members pass over the bowed out portions in the carton side members so that the slits in the carton and lid come into registration, and whereby the bowed out portion of the flap in the side members interferes with the bowed out portion of the flap on the lid flange members thereby locking the lid and carton together.

2. An interlocking carton and lid according to claim 1 wherein said carton and lid are fabricated from a cardboard material having a suitable fibrous component so that, when the cardboard is creased, tension is generated out of the plane of the cardboard in the local neighborhood of the crease in the carton and lid.

3. An interlocking carton and lid according to claim 1 wherein the slits located on the side members of the carton include a first slit portion extending substantially parallel to said crease on the carton, and including second slit portions extending from each end of said central slit portions downwardly away from the crease and outwardly from the central portion of the slit.

4. An interlocking carton and lid according to claim 1 and the slits located on the lid flap members include a first slit portion extending substantially parallel to said crease on said flange, and including second slit portions extending downwardly away from the crease and outwardly from the central portion of the respective slits.

5. An interlocking carton and lid according to claim 1 wherein the slits located on the side members of the carton and the slits located on the lid flap members include a first slit portion extending substantially parallel to said crease on said members, and including second slit portions extending downwardly away from the crease and outwardly from the central portion of the slit.

* * * * *